US007399937B2

(12) United States Patent
Nishimura

(10) Patent No.: US 7,399,937 B2
(45) Date of Patent: Jul. 15, 2008

(54) MOVABLE-CONTACT UNIT AND PANEL SWITCH USING THE SAME

(75) Inventor: Takahiro Nishimura, Okayama (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 11/783,574

(22) Filed: Apr. 10, 2007

(65) Prior Publication Data

US 2008/0006517 A1 Jan. 10, 2008

(30) Foreign Application Priority Data

Jul. 6, 2006 (JP) ..... 2006-186415

(51) Int. Cl.
*H01H 9/18* (2006.01)

(52) U.S. Cl. ..... 200/314; 200/516

(58) Field of Classification Search ..... 200/406, 200/512, 516, 517, 310, 314, 317; 341/22, 341/23, 27, 28; 345/156, 168, 169, 173, 345/176; 379/368, 433.07; 455/90.3, 550.1
See application file for complete search history.

(56) References Cited

U.S. PATENT DOCUMENTS 6,373,008 B1 * 4/2002 Saito et al. ..... 200/310
6,595,653 B2 * 7/2003 Saito et al. ..... 362/84
6,710,007 B2 * 3/2004 Brookhart et al. ..... 502/155
6,917,007 B2 * 7/2005 Hirai et al. ..... 200/516
6,946,610 B2 * 9/2005 Takeuchi et al. ..... 200/406
6,982,394 B2 * 1/2006 Ide et al. ..... 200/516
7,005,595 B1 * 2/2006 Tang ..... 200/310
7,015,408 B2 * 3/2006 Hirahata et al. ..... 200/310
7,064,288 B2 * 6/2006 Nam ..... 200/406
7,129,435 B2 * 10/2006 Sano ..... 200/512

FOREIGN PATENT DOCUMENTS

JP 10-144172 5/1998
JP 2001-273831 10/2001

* cited by examiner

*Primary Examiner*—Michael A Friedhofer
(74) *Attorney, Agent, or Firm*—Wenderoth, Lind & Ponack, L.L.P.

(57) ABSTRACT

A movable-contact unit to be used in an operating panel of various electronic devices is disclosed. The movable-contact unit is formed of movable contacts directly held on an inorganic EL sheet. To obtain adequate tactile feedback from the movable contacts even in a low temperature environment, a holding section of adhesive is patterned on the underside of the inorganic EL sheet such that the area of the holding section is not less than 25% and not greater than 50% of the area of the movable contact. Then the movable contact is held adhesively by this patterned holding section of the adhesive.

2 Claims, 5 Drawing Sheets

MOVABLE-CONTACT UNIT AND PANEL SWITCH USING THE SAME

FIELD OF THE INVENTION

The present invention relates to a movable-contact unit to be used in an operating panel for various electronic devices, and it also relates to a panel switch using the same movable-contact unit.

BACKGROUND OF THE INVENTION

A variety of electronic devices have various structures in their inputting sections. Portable devices, among other electronic devices and typically represented by portable phones, have increasingly used a panel switch as an operating panel. The panel switch is formed by placing a movable-contact unit on a printed wired board of an electronic device, and the movable-contact unit is formed by adhesively holding movable contacts on the underside of a base sheet made of insulating film such as PET.

Due to their portability, the portable devices can be used in various environments including a wide range of temperature, so that the operating panel needs to be capable of operating smoothly in the various environments. The foregoing conventional movable-contact unit and the panel switch using the conventional movable-contact unit are described hereinafter.

FIG. 6 shows a sectional view of the conventional movable-contact unit, FIG. 7 shows a sectional view of the panel switch formed of the conventional movable-contact unit, and FIG. 8 shows a perspective exploded view of the same panel switch.

As illustrated in the sectional view of FIG. 6, conventional movable-contact unit 10 is formed this way: domed movable contact 5 made of a thin metal sheet is held on the underside of base sheet 1 at its center top face, which base sheet 1 is made of insulating film such as PET. In general, adhesive 3 is patterned on the underside of base sheet 1, and then movable contact 5 is adhesively held by holding section 3A of adhesive 3.

The placement of movable contacts 5 is determined in response to an operating panel of a device, and a plurality of movable contacts 5 are placed independent of each other, thereby forming panel switch 20.

Adhesive 3 formed on the underside of base sheet 1 is also available around movable contacts 5, and the surrounding sections 3B of adhesive 3 holds separator 7, which has a top face that has undergone a releasing process, on the underside of sheet 1. Separator 7 is laminated entirely on the underside of sheet 1 in order to prevent the adhesion of dust to movable contacts 5 during transportation and storage.

Before movable-contact unit 10 is used, separator 7 is removed by using its releasing process, and movable-contact unit 10 is bonded to wired board 15 (ref. FIGS. 7 and 8) of the device by surrounding sections 3B exposed at the underside of base sheet 1. Wired board 15 includes a fixed contact on its top face, and the fixed contact is formed of outer fixed contact 17A and center fixed contact 17B in pairs.

As shown in FIG. 7, each one of contacts 5 of movable-contact unit 10 is placed on outer fixed contact 17A corresponding to the contact 5 at its lower end of the outer rim, so that contact 5 is adhesively placed on wired board 15, thereby forming panel switch 20. On top of panel switch 20, key mat 25 is placed for depressing movable contact 5, so that the operating panel is constructed.

Panel switch 20 operates this way: key mat 25 is depressed at its keytop, such that pressing force is applied to corresponding movable contact 5 via base sheet 1. When the force exceeds a given value, the center of movable contact 5 is reversed producing tactile feedback, so that the bottom of contact 5 touches center fixed contact 17B, i.e. outer fixed contact 17A is shorted to center fixed contact 17B via movable contact 5. When the depressing force is removed, movable contact 5 restores itself to its original position (switch-off position as shown in FIG. 7).

Panel switch 20 discussed above provides the user with excellent tactile feedback (click feeling) in a slim structure, so that it has been widely used in portable phones which have become progressively slimmer.

It has recently been preferred to have the keytop of key-mat 25 illuminated, and thus it has been proposed that an LED mounted on wired board 15 as a light source for the illumination be replaced with an EL (electro luminescent) sheet. Because the EL sheet can be used as a surface light source and allows illumination of an object with its surface emission. FIG. 9 shows a sectional view of an example of the EL sheet, and this example, called an inorganic EL sheet, comprises the following elements:

(a) optically transparent base film 30 made of, e.g. PET (polyethylene terephthalate), and placed on the light emitting side, i.e. placed as the top face of the EL sheet; and (b) transparent electrode layer 31, light emitting layer 32, dielectric layer 33, back electrode layer 34, and insulating layer 35, laminated and printed on the underside of film 30 in this order. It has been proposed that this inorganic EL sheet 40 be placed beneath key mat 25, or that movable contacts 5 be bonded directly to EL sheet 40, thereby forming a movable-contact unit. Related prior art is disclosed in, e.g. Unexamined Japanese Patent Publication No. H10-144172, or No. 2001-273831.

Recently, devices have been downsized and slimmed, so that the inventors of the present invention think that a surface light source in a slim body is useful as a movable-contact unit, one of the elements of an operating panel of the devices. The inventors thus have studied the replacement of base sheet 1 of conventional movable-contact unit 10 with inorganic EL sheet 40.

The movable-contact unit under study employs inorganic EL sheet 40; however, EL sheet 40 has a problem in that it is thicker than conventional base sheet 1 because of its multilayer printings, and yet, it becomes highly rigid in a low temperature environment. The inventors thus encountered the problem that the operation in the low temperature environment provides the user with degraded tactile feedback obtained from movable contacts 5. In the environment at −20° C. that is generally the lower limit of operating a mobile communication device such as a portable device, almost no tactile feedback is obtained from movable contacts 5.

SUMMARY OF THE INVENTION

The present invention addresses the problem discussed above, and aims to provide a movable-contact unit formed of an inorganic EL sheet which holds movable contacts directly, and the movable-contact unit provides the user with adequate tactile feedback even in a low temperature environment. The present invention also aims to provide a panel switch employing the foregoing movable-contact unit.

The movable-contact unit of the present invention is formed of an EL sheet, and domed movable contacts made of thin metal sheets and held adhesively on the underside of the EL sheet at their top faces via adhesive. The adhesively held status of the unit by the EL sheet can be set such that the movable-contact unit can provide the user with adequate tactile feedback even in a low temperature environment. To be more specific, the adhesive used for holding the movable contacts has an area of 25-50% of the area of each one of the movable contacts, and the adhesive is patterned within the foregoing area ratio for holding each one of the movable contacts. The foregoing area ratio allows the movable contacts to provide the user with tactile feedback almost free from degradation even in the low temperature environment.

DETAILED DESCRIPTION OF PREFERRED EMBODIMENT

An exemplary embodiment of the present invention is demonstrated hereinafter with reference to FIG. 1-FIG. 5, and similar elements to those used in the conventional model have the same reference marks and the descriptions thereof are omitted here.

Exemplary Embodiment

Figure 1:
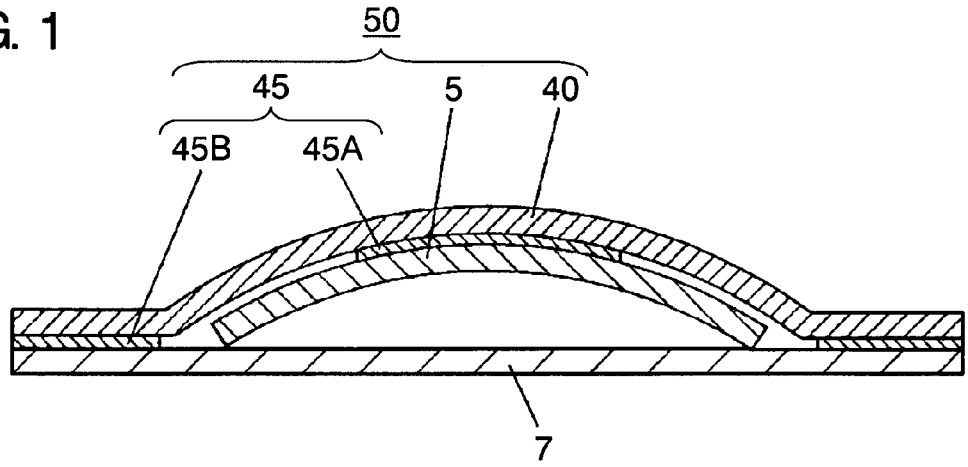
FIG. 1 shows a sectional view of a movable-contact unit in accordance with an embodiment of the present invention.
Figure 2:
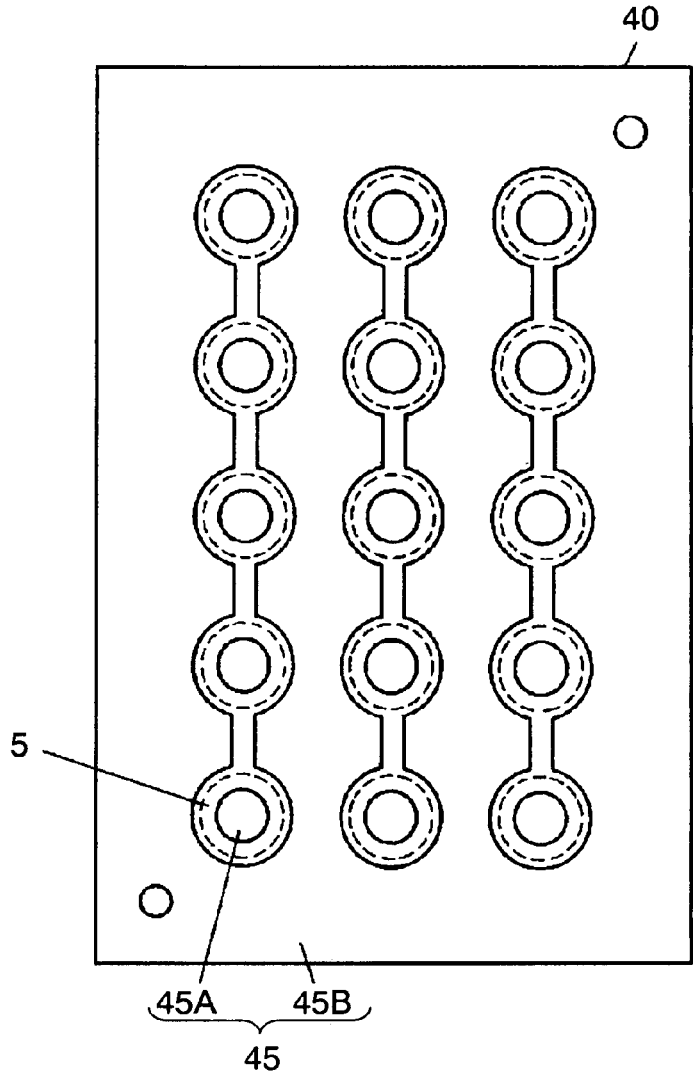
FIG. 2 shows a bottom view illustrating adhesive patterned on an inorganic EL sheet, an essential part of the movable-contact unit.
Figure 3:
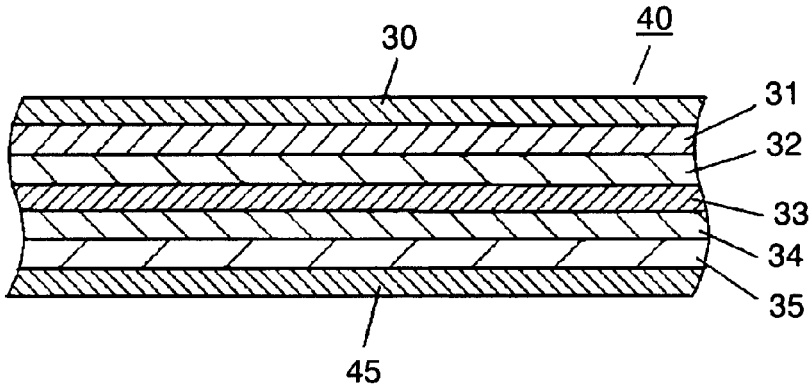
FIG. 3 shows a sectional view illustrating the adhesive printed on the inorganic EL sheet, an essential part of the movable-contact unit.

FIG. 1 shows a sectional view of a movable-contact unit in accordance with the embodiment of the present invention. FIG. 2 shows a bottom view illustrating the adhesive patterned on an inorganic EL sheet, an essential part of the movable-contact unit. FIG. 3 shows a sectional view illustrating the adhesive printed on the inorganic EL sheet, an essential part of the movable-contact unit. As shown in FIG. 1, movable-contact unit 50 is formed this way: acrylic adhesive 45 is printed on inorganic EL sheet 40 per se, then movable contacts 5 are bonded to EL sheet 40 via adhesive 45.

Adhesive 45 is the same adhesive used in the conventional unit, and the formed pattern of adhesive 45 is a critical point of the structure described in this embodiment, so that the adhesive is marked with a new reference mark "45" both in the drawings and the descriptions hereinafter. FIG. 3 shows inorganic EL sheet 40; however, detailed illustrations of the respective functional layers are omitted here.

Adhesive 45 discussed above is patterned on the underside of EL sheet 40 as shown in FIG. 2. To be more specific, inorganic EL sheet 40 is formed by laminating and printing the following layers on the underside of film 30 which is placed as the top face of EL sheet 40: transparent electrode layer 31, light emitting layer 32, dielectric layer 33, back electrode layer 34, and insulating layer 35 in this order. Adhesive 45 is printed on the underside of insulating layer 35 (refer to FIG. 3).

Adhesive 45 is patterned on layer 35 this way: As shown in FIG. 2, the pattern comprises holding section 45A for holding each one of movable contacts 5 and surrounding section 45B for surrounding each one of movable contacts 5. Holding section 45A forms a round shape at a place where movable contact 5 is placed.

Holding section 45A is formed smaller than the conventional one and adhesively holds the top face of movable contact 5. This structure is detailed later. Surrounding section 45B is formed extensively to the fringe of EL sheet 40.

Movable-contact unit 50 is thus constructed, and separator 7 is bonded onto the underside of unit 50 with surrounding section 45B. Separator 7 protects movable contact 5 from dust and protects the functional layers of EL sheet 40.

Movable-contact unit 50 is removed from separator 7 before movable contact unit 50 is used, and movable contact unit 50 is then bonded onto wired board 15 of the device with surrounding section 45B of adhesive 45, so that panel switch 60 becomes ready for use. In this status, the terminal section (not shown) of inorganic EL sheet 40 is coupled to a predetermined power feeding line (not shown).

Key mat 25 is placed over the foregoing panel switch 60 for depressing respective movable contacts 5, thereby completing an operating panel. In this operating panel, application of a given voltage to inorganic EL sheet 40 realizes surface light emission so as to illuminate an extensive area, e.g. the whole surface of EL sheet 40, and then key mat 25 placed over EL sheet 40 is illuminated. Since the key mat 25 is made of optically transparent material, the keytop can be highly and uniformly illuminated. Key mat 25 adaptable to the foregoing structure can limit the area to be illuminated as necessary.

Figure 4:
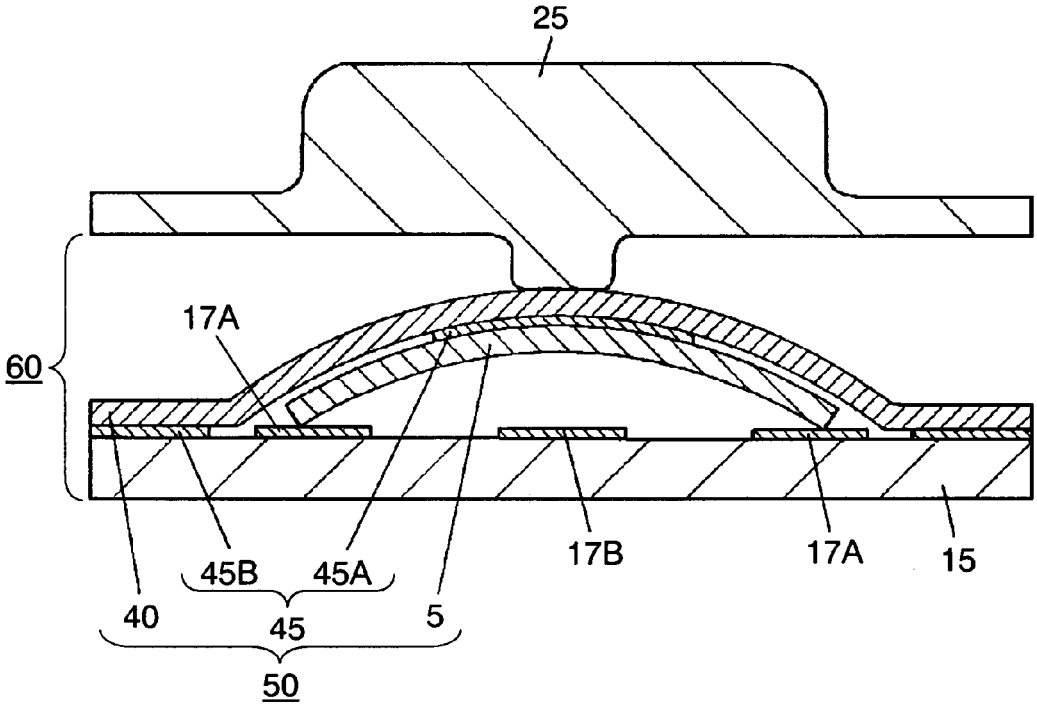
FIG. 4 shows a sectional view of a panel switch employing the movable-contact unit shown in FIG. 1.
Figure 5:
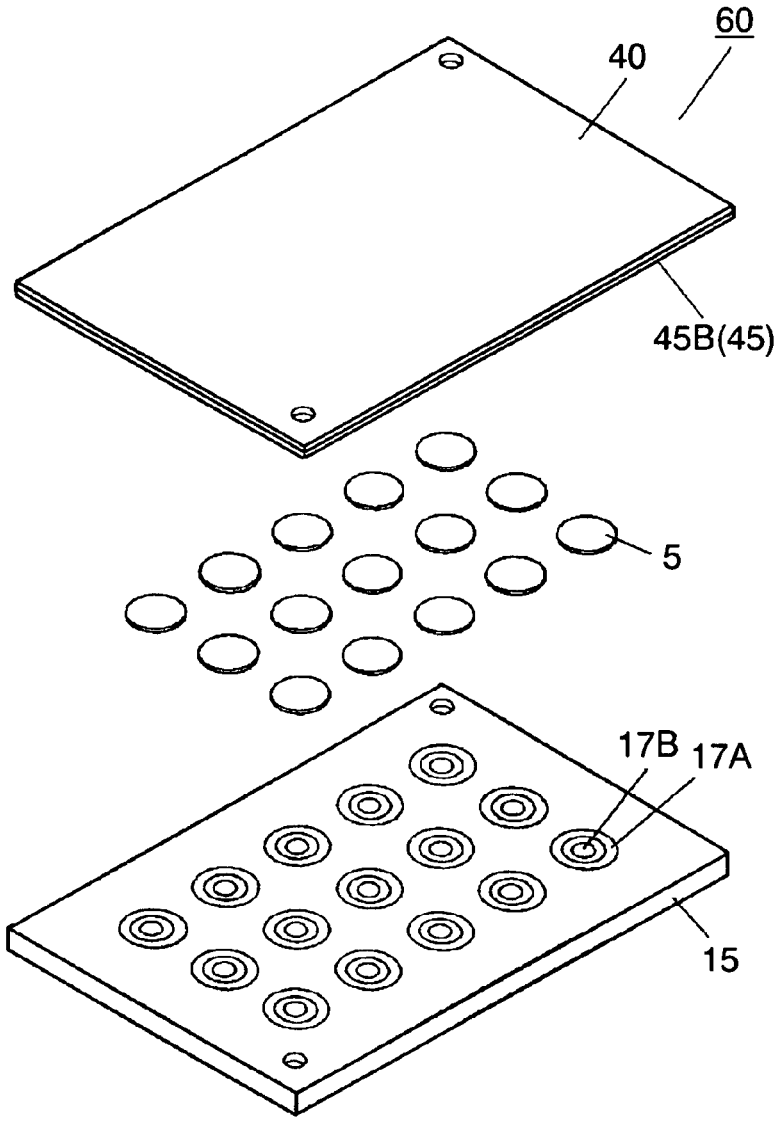
FIG. 5 shows a perspective exploded view of the panel switch shown in FIG. 4.
Figure 6:
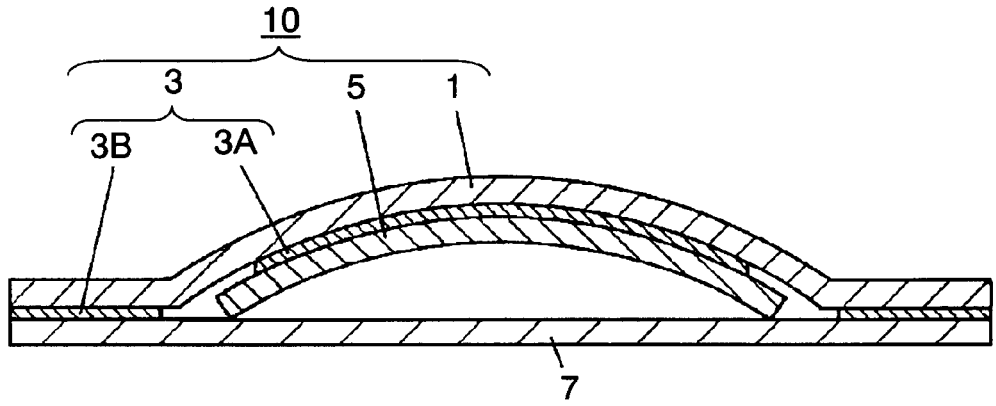
FIG. 6 shows a sectional view of a conventional movable-contact unit.
Figure 7:
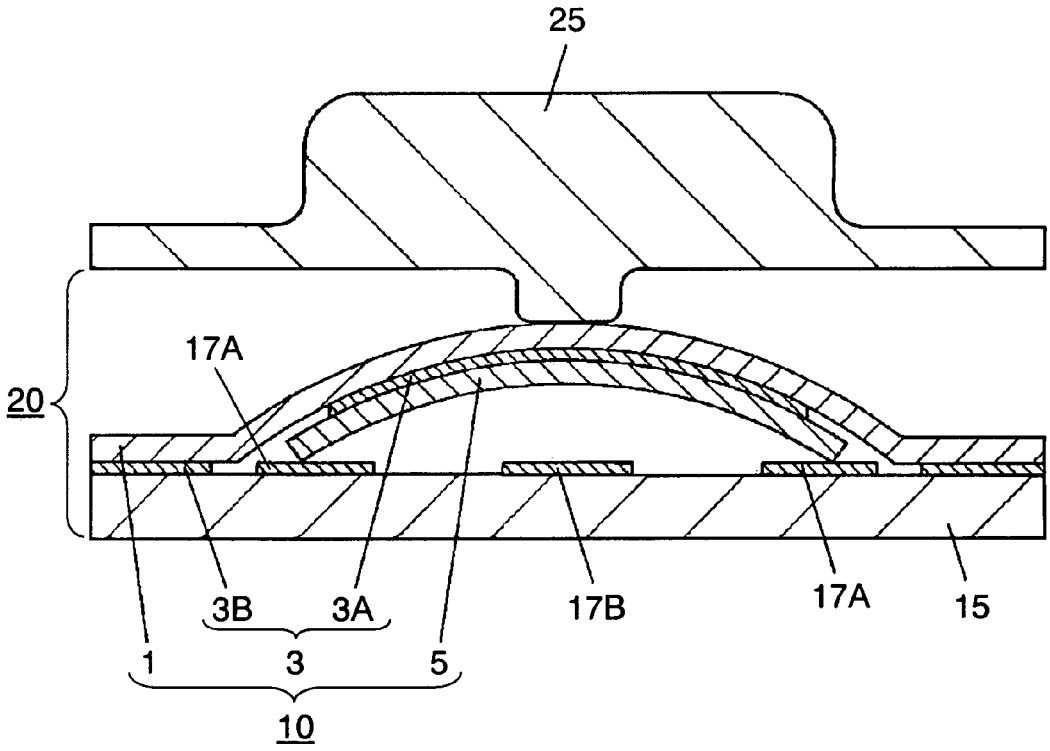
FIG. 7 shows a sectional view of a panel switch employing the conventional movable-contact unit.
Figure 8:
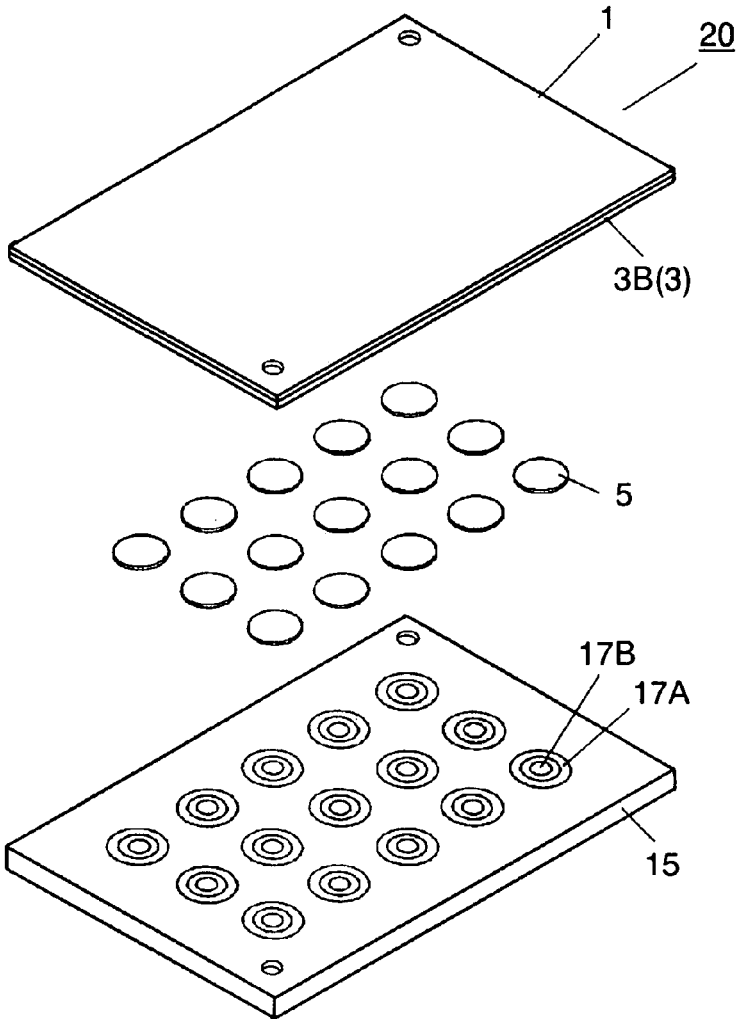
FIG. 8 shows a perspective exploded view of the panel switch shown in FIG. 7.
Figure 9:
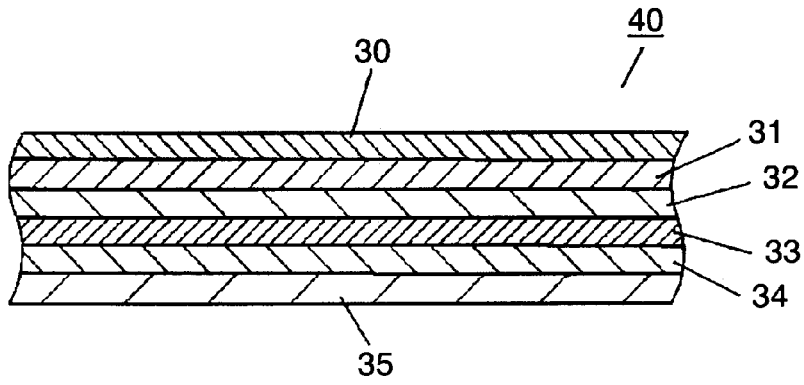
FIG. 9 shows a sectional view illustrating a structure of an inorganic EL sheet.

The movement of the operating panel is described hereinafter, i.e. the user operates the foregoing panel switch 60 this way: Pressing the keytop of key mat 25 prompts EL sheet 40 to apply depressing force to movable contact 5, and when the depressing force exceeds a given value, the center section of movable contact 5 is reversed producing tactile feedback, so that the underside of the center section touches center fixed contact 17B placed on wired board 15. This mechanism allows outer fixed contact 17A, on which the lower end of outer rim of movable contact 5 is placed, to short with center fixed contact 17B; in other words, the switch is turned on. Then removal of the operating force causes movable contact 5 to restore itself to its original position; namely, the switch is turned off as shown in FIG. 4.

To obtain adequate tactile feedback from movable-contact unit 50 even in the low temperature environment, the diameter of holding section 45A of adhesive 45 is patterned such that the area ratio of the holding section 45A vs. the plane projection area of movable contact 5 falls within 25-50%. The reason why the diameter is determined at the foregoing range is described hereinafter.

The inventors of the present invention firstly formed and tested a movable-contact unit in the following manner. Holding section 45A, measuring 3.6 mm in diameter, the same diameter as the conventional one, was formed of adhesive 45 on inorganic EL sheet 40, and then the domed movable contact 5 measuring 4 mm across and 0.2 mm high was adhered to the EL sheet 40 with holding section 45A, thereby forming the movable-contact unit. The movable-contact unit was then exposed to an environment of 0° C. for one hour. Then the movable-contact unit was tested to determine whether or not it works well in the same environment. Next, the units were exposed to low temperature environments at −10° C. and −20° C. for one hour respectively, and then the units were tested to determine whether or not they work well in the respective environments.

According to the test results, the unit exposed at 0° C. offered a tactile feedback similar to the one at an ordinary temperature; however, the units exposed at −10° C. and −20° C. offered almost no tactile feedback. The inventors presume that the foregoing result is caused by the following fact: Inorganic EL sheet 40 is formed of the respective functional layers laminated by printing the paste in which resin is used as binder, so that the functional layers become inflexible at the low temperature environment such as at −10° C. and −20° C. Inorganic EL sheet 40 as a whole thus becomes rigid. This fact is presumed as a major cause of the poor tactile feedback. The low temperature environment also raises the viscosity of adhesive 45, which then tends to be cured. Use of holding section 45A with the same large area as the conventional one for bonding movable contact 5 to EL sheet 40 will interfere with the movement of movable contact 5 because of the properties of adhesive 45.

The inventors thus prepared five types of holding sections 45A, namely, holding section 45A measuring 2.0 mm, 2.4 mm, 2.8 mm, 3.2 mm, and 3.6 mm across for adhesively holding the foregoing movable contact 5 measuring 4.0 mm across. The respective holding sections 45A holding movable contact 5 were exposed in the environments of 0° C., −10° C. and −20° C. for one hour, and then their movements were tested in the foregoing environments respectively. Table 1 shows the results. In this test, holding section 45A was formed in the same thickness as the conventional one, i.e. 15 μm, and inorganic EL sheet having 100 μm thickness was used.

TABLE 1

| adhesive: pattern ϕ | area ratio | 0° C. | −10° C. | −20° C. |
|---|---|---|---|---|
| ϕ2.0 | 25.0% | AA | AA | A |
| ϕ2.4 | 36.0% | AA | AA | A |
| ϕ2.8 | 49.0% | AA | A | B |
| ϕ3.2 | 64.0% | AA | B | C |
| ϕ3.6 | 81.0% | AA | C | C |

area ratio: area of holding section 45A vs. plane projection area of movable contact 5, AA: tactile feedback similar to that at an ordinary temperature, A: tactile feedback somewhat inferior to that at the ordinary temperature; however, it had no problem in practical use, B: slow tactile feedback, C: almost no tactile feedback.

Table 1 shows that holding sections 45A measuring 2.0 mm and 2.4 mm across exposed in the environments of 0° C., −10° C. offer the tactile feedback free from deterioration in tactile feeling, and the same holding sections 45A having undergone −20° C. environment offer somewhat inferior tactile feedback to that at an ordinary temperature; however, they have no problem in practical use.

The foregoing test has been done by several testers selected out of people who frequently use a portable phone, and the testers operated movable contact 5 in the foregoing environments for comparing the tactile feedback under normal usage. The testers classify their feelings into four groups, i.e. AA: feeling similar to that at an ordinary temperature, A: feeling somewhat inferior to that at the ordinary temperature; however, it had no problem in practical use, B: slow tactile feeling, C: almost no tactile feeling.

Holding section 45A measuring 2.8 mm across underwent the same test to find this result: holding section 45A exposed at 0° C. offered tactile feeling similar to that at the ordinary temperature, and holding section 45A exposed at −10° C. offered a feeling somewhat inferior to that at the ordinary temperature; however, it had no problem in practical use. Holding section 45A exposed at −20° C. offered slow tactile feeling.

These results prove that movable contact 5 adhesively held by holding section 45A measuring 2.8 mm across offers degraded tactile feedback when this movable-contact unit is mounted to the device exposed to the environment of −20° C. for a long time, and the user experiences poor operation.

Portable devices such as portable phones are not kept leaving in the pocket under the environment of −20° C. for a long time. Considering this fact, since movable contact 5 held by a holding section measuring 2.8 mm across and exposed at −10° C. can offer a tactile feedback that is practically usable, it can be determined that this movable-contact unit can be used.

On the other hand, movable contact 5 held by a holding section measuring 3.2 mm across and exposed at −10° C. offers only slow tactile feedback, and yet, the same one exposed at −20° C. offers almost no tactile feedback. Movable contact 5 held by holding section 45A measuring 3.6 mm across, the same diameter as the conventional one, and exposed at −10° C. or −20° C. offers almost no tactile feedback.

As discussed above, when movable contact 5 measuring 4 mm across is adhesively placed on inorganic EL sheet 40, holding section 45A measuring 2.0-2.8 mm across can appropriately hold movable contact 5. To be more specific, the area of holding section 45A is desirably set at not less than 25% and not greater than 50%, i.e. preferably 49%, with respect to the plane projection area of movable contact 5. On top of that, use of holding section 45A measuring 2.0-2.4 mm across allows the device to be left in a low temperature environment such as at −20° C. for a long time and to offer a tactile feedback that is practically usable.

Based on the foregoing results, it can be presumed that holding section 45A measuring less than 2.0 mm across can offer good tactile feedback even in a low temperature environment; however, in this case, the adhesive holding area becomes smaller, so that it must be studied whether or not movable contact 5 can be held steadily in frequent use.

As discussed above, setting an adhesive holding status of movable contacts 5 onto inorganic EL sheet 40 allows movable-contact unit 50 to offer adequate tactile feedback even in the low temperature environment. Elements other than the foregoing ones, e.g. movable contact 5 having a different diameter, inorganic EL sheet 40 having a different thickness, holding section 45A having a different shape can be included in the scope of the present invention as long as they can produce the advantage similar to what is discussed above, namely, that setting an adhesive holding status of movable contacts onto an inorganic EL sheet allows the movable-contact unit to offer adequate tactile feedback even in the low temperature environment.

Since the present invention only sets a status of the holding section of the movable contact, no additional components in structure or no additional steps in manufacturing are needed for carrying out the present invention.

The panel switch employing the movable-contact unit of the present invention is formed of an EL sheet, and domed movable contacts are held adhesively on the underside of the EL sheet at their top faces directly with adhesive. The panel switch can provide the user with adequate tactile feedback even in a low temperature environment, so that it can be useful as an operating panel of various electronic devices.

What is claimed is:

1. A movable-contact unit comprising:

an electro luminescent sheet having a topside surface and an underside surface; and a domed movable contact having a top face and a bottom face and being formed of a thin metal sheet, said top face of said domed movable contact being adhered to said underside surface of said electro luminescent sheet via a holding section constituting an adhesive interposed between said top face of said domed movable contact and said underside surface of said electro luminescent sheet;

wherein said holding section has a diameter of not less than 2.0 mm and not greater than 2.8 mm.

2. A panel switch employing the movable-contact unit according to claim 1.

* * * * *